US007080501B2

(12) United States Patent
Pyra

(10) Patent No.: US 7,080,501 B2
(45) Date of Patent: Jul. 25, 2006

(54) YARN FALSE TWIST TEXTURING APPARATUS

(75) Inventor: Michael Pyra, Brüggen (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 93 days.

(21) Appl. No.: 10/972,601

(22) Filed: Oct. 25, 2004

(65) Prior Publication Data

US 2005/0055998 A1 Mar. 17, 2005

Related U.S. Application Data

(63) Continuation of application No. PCT/EP03/04045, filed on Apr. 17, 2003.

(30) Foreign Application Priority Data

Apr. 26, 2002 (DE) ..... 102 18 748

(51) Int. Cl.
*D02G 1/00* (2006.01)

(52) U.S. Cl. ..... 57/284; 57/286

(58) Field of Classification Search ..... 57/284–292, 57/332–349

See application file for complete search history.

(56) References Cited

U.S. PATENT DOCUMENTS 4,020,196 A 4/1977 Guillermin et al.
4,115,985 A * 9/1978 Venot ..... 57/286
6,026,636 A 2/2000 Lorenz et al.
6,209,302 B1 * 4/2001 Wortmann et al. ..... 57/290
6,258,406 B1 * 7/2001 Enders et al. ..... 427/175
6,543,580 B1 * 4/2003 Gathmann et al. ..... 184/7.4

FOREIGN PATENT DOCUMENTS

DE 29 39 281 A1 4/1981
DE 197 53 806 A1 6/1998
EP 0 879 907 A1 11/1998
FR 2 717 505 9/1995

* cited by examiner

*Primary Examiner*—Shaun R Hurley

(74) *Attorney, Agent, or Firm*—Alston & Bird LLP

(57) ABSTRACT

A texturing apparatus for draw texturing a synthetic yarn. To this end, the texturing machine comprises a first feed system, a heating device, a cooling device, a texturing unit, a second feed system, and a takeup device for winding the textured yarn. Between the heating device and the cooling device, a wetting device is provided for wetting the heated yarn with a cooling fluid for purposes of precooling. The wetting device consists of a rotatable cooling cylinder which includes on its circumference a yarn track that contains a cooling fluid. The yarn can be wetted by contacting the yarn track. At the point of contact, the yarn friction is advantageously dependent on the relative speed between the yarn and the yarn track on the circumference of the cooling cylinder.

17 Claims, 4 Drawing Sheets

YARN FALSE TWIST TEXTURING APPARATUS

CROSS REFERENCE TO RELATED APPLICATION

The present application is a continuation of international application PCT/EP03/04045, filed 17 Apr. 2003, and which designates the U.S. The disclosure of the referenced application is incorporated herein by reference.

BACKGROUND OF THE INVENTION

The invention relates to a texturing apparatus for draw texturing a synthetic multifilament yarn. A conventional texturing machine of this general type is disclosed, for example, in EP 0 879 907 A1 and corresponding U.S. Pat. No. 6,026,636.

Texturing machines of this type are used for texturing one or more yarns, from a melt spun, flat yarn to produce a bulked and crimped yarn, which is suited for further processing to form a knit or woven fabric. To this end, the spun, flat yarn is withdrawn from a feed yarn package, textured and drawn within a texturing zone that includes a heating device, a cooling device, and a texturing unit, and wound to a package after having been textured.

For improving the cooling effect, the texturing zone may accommodate between the heating device and the cooling device a wetting device, which is used to apply a cooling fluid to the yarn. To this end, the yarn advances over a wetted surface in contact therewith, which causes an additional yarn friction within the texturing zone. This influences in the yarn the return of the false twist that has been imparted to the yarn by the texturing unit. Depending on the yarn type, this effect can initially be positive for preventing, for example, a so-called searching. However, in the case of yarn types, which distinguish themselves by a fine denier, this effect becomes so negative that the yarn is inadequately twisted within the heating device while undergoing thermal treatment.

It is therefore an object of the invention to further develop a standard texturing machine of the initially described type in such a manner that the yarn can be wetted between the heating device and the cooling device with as little friction as possible.

A further object of the invention is to improve the wetting of the yarn between the heating device and the cooling device such that desired yarn friction conditions are adjustable as a function of yarn speeds and yarn types.

SUMMARY OF THE INVENTION

The above and other objects and advantages of the invention are achieved by the provision of a yarn wetting device positioned between the heating device and the cooling device, with the wetting device comprising a rotatable cooling cylinder which carries a cooling fluid on a circumferential yarn track. The cooling cylinder is positioned so that the advancing yarn is guided into contact with the yarn track.

The invention distinguishes itself in that when the yarn contacts the wetting yarn track, a yarn friction develops, which depends on the relative speed between the yarn and the yarn track. The yarn track on the circumference of the cooling cylinder contains a cooling fluid that can be transferred to the yarn, when being contacted by it. On the one hand, the rotational movement of the cooling cylinder causes only a defined friction to be operative as a result of the relative movement between the yarn and the yarn track. On the other hand, it accomplishes a continuous, uniformly metered wetting of the yarn. The advancing yarn is in constant contact with a surface of the yarn track that is wetted with a metered amount of fluid. The positive effects resulting from wetting the yarn, such as washing out residues of a yarn lubricant and precooling the yarn remain unchanged.

The metering of the cooling fluid by the rotatable cooling cylinder is preferably determined such that the cooling fluid fully evaporates when the yarn comes into contact with the cooling device. This ensures that the yarn advances into the downstream cooling device in an absolutely dry state, so that, for example, cooling rails or cooling tubes do not soil when the yarn advances over their surface. However, it is also possible to select the wetting of the yarn such that certain residual moisture remains in the yarn. This variant is applicable in particular in the case of cooling devices, which cool the yarn in a free cooling zone without contacting it. With that, it is possible to adjust on the yarn any degree of drying.

Further advantageous developments of the invention provide the advantage that the yarn friction is adjustable when the yarn is wetted. To this end, the cooling cylinder is operated by a drive unit that is preferably an electric motor. In this case, the cooling cylinder can be driven to rotate both in the direction of the advancing yarn and in the direction opposite to the advancing yarn. To obtain yarn frictions that are as low as possible, the cooling cylinder is driven to rotate in the same direction as the advancing yarn. This permits minimizing the yarn friction in a condition, in which the yarn and the yarn track of the cooling cylinder have the same speeds. To produce in other yarn types, for example, a higher yarn friction, it is also possible to drive the cooling cylinder to rotate in the opposite direction to the advancing yarn. The yarn and the yarn track thus move in opposite directions, which leads to a high friction in the yarn while being wetted. With the use of a controllable electric motor it is possible to realize irrespective of its wound direction of rotation, an adaptation of the circumferential speed of the cooling cylinder to any speed of the advancing yarn that is adjusted within the texturing zone.

To have available in the yarn track an adequate quantity of cooling fluid in the case of yarn speeds above 1,000 m/min., an advantageous further development provides for arranging the yarn track on the circumference of the cooling cylinder preferably as a groove. With that, the yarn advances for purposes of being wetted, inside the groove on the circumference of the cooling cylinder. The cross section of the groove is formed such as to ensure that the cooling fluid continues to adhere to the groove bottom even at higher circumferential speeds of the cooling cylinder.

It is preferred to use a metering device for supplying the cooling fluid to the yarn track on the circumference of the cooling cylinder. The metering device may be constructed as a dip bath, which contains a supply of cooling fluid and into which the circumference of the cooling cylinder immerses in part.

However, it is also possible to form the metering device by a nozzle, which is arranged in the interior of the cooling cylinder or outside of the cooling cylinder for supplying the cooling fluid to the yarn track.

A particularly advantageous development of the invention provides for arranging the heating device, the cooling cylinder, and the cooling device to form a substantially straight yarn path. With that, it is possible to form a texturing zone, in which additional yarn guide elements and thus frictions of the yarn are avoided.

However, such low-friction texturing zones can also advantageously be realized in the case of a yarn path that is bent between the heating device and the cooling device, in that the yarn is deflected by the cooling cylinder. This type of further development of the invention is thus especially suited for realizing a compact machine construction. To this end, the heating device and the cooling device are mounted in a machine frame preferably in an inverted V-shape, with the apex of the V-shaped arrangement mounting the cooling cylinder for deflecting the yarn.

For purposes of simultaneously wetting as much as possible a plurality of parallel advancing yarns, an advantageous further development of the invention provides for constructing the cooling cylinder on its circumference with a plurality of parallel extending yarn tracks. In this instance, it is possible to associate to each yarn track a separate or a common metering device.

Since an intensive cooling of the yarn by a cooling fluid proceeds directly at the outlet of the heater along with the evaporation of a cooling fluid, a further development provides for arranging the cooling cylinder inside a collection chamber, so that the produced vapors are removable by a suction device that connects to the collection chamber.

BRIEF DESCRIPTION OF THE DRAWINGS

In the following, further advantages and positive effects of the invention are described in greater detail by means of some embodiments of the texturing machine according to the invention and with reference to the attached drawings, in which.

DETAILED DESCRIPTION OF THE PREFERRED EMBODIMENTS

Figure 1:
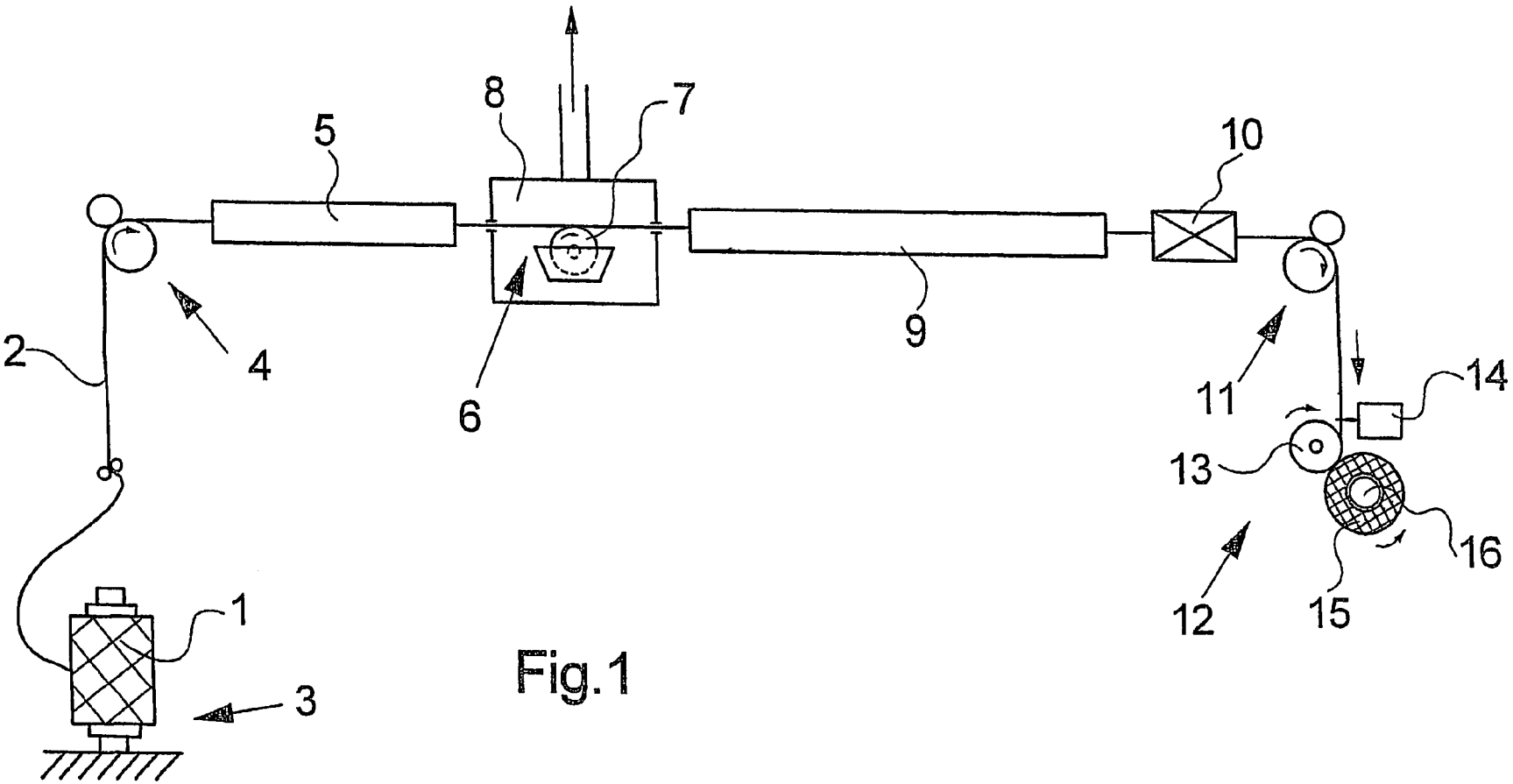
FIG. 1 is a schematic view of a processing station of an embodiment of the texturing machine according to the invention.

FIG. 1 schematically illustrates a processing station of a first embodiment of a texturing machine according to the invention. An illustration of the components of a machine frame for mounting the individual processing units has been omitted.

A creel frame 3 mounts a feed yarn package 1. The feed yarn package 1 holds a yarn 2, which is withdrawn from the feed yarn package 1 by a first feed system 4. Arranged in the path of the yarn downstream of the first feed system 4 are a heating device 5, a wetting device 6, a cooling device 9, a texturing unit 10, as well as a second feed system 11. From the second feed system 11, the yarn 2 advances to a takeup device 12, where the yarn 2 is wound to a package 15. The takeup device 12 comprises a drive roll 13, a yarn traversing device 14, and a package holder 16. The package 15 is driven by the drive roll 13 at a substantially constant peripheral speed.

Within a texturing zone formed between the first feed system 4 and the second feed system 11, the wetting device 6 is positioned between the heating device 5 and the cooling device 9. The wetting device 6 comprises a rotatably supported cooling cylinder 7, which is described in greater detail below. The cooling cylinder 7 is housed in a collection chamber 8, and the collection chamber 8 connects to a suction device as indicated by the vertical arrow.

In the texturing machine of the invention as shown in FIG. 1, the yarn 2 is drawn and simultaneously textured within a texturing zone after its withdrawal from the feed yarn package 1. For its texturing, the yarn 2 is imparted with false twist by the texturing unit 10, which is preferably formed by a friction unit. Within the texturing zone, the false twist propagates in the yarn 2 back against the direction of the advancing yarn, so that the multifilament yarn 2 undergoes a crimping by the heating device 5 arranged in the texturing zone and the cooling device 9 extending downstream thereof. Preferably, the heating device 5 is a high-temperature heater, whose heating surfaces are heated to a temperature above the melt point of the yarn. To this end, the yarn 2 advances through the heating device 5 substantially without contacting it. However, it is also possible to form the heating device 5 by a contact heater.

After its heat treatment, the yarn advances into the wetting device 6. To this end, the yarn 2 enters the collection chamber 8 through a yarn inlet end, and contacts the cooling cylinder 7 that is driven at a circumferential speed. On the circumference of the cooling cylinder 7, a yarn track contains a cooling fluid, which wets the heated yarn 2. The quantity of the cooling fluid that is applied to the yarn 2 is metered such that after leaving the collection chamber 8, the yarn holds no residues of the cooling fluid, since these have been evaporated inside the collection chamber 8. The developing vapor is removed by the suction device.

After its precooling, the yarn 2 undergoes a final cooling within the cooling device 9. To this end, the cooling device 9 could be constructed as a cooling rail or a cooling tube, with the yarn advancing along it in contact with its surface. However, it is also possible to form the cooling device by a free cooling zone, in which the yarn is cooled without contact by external or ambient air.

After its cooling, the yarn 2 advances through the texturing unit 10, and is guided by the second feed system 11 to the takeup device 12. The first feed system 4 and the second feed system 11 are driven at different speeds, so that the yarn 2 is simultaneously drawn.

Figure 2:
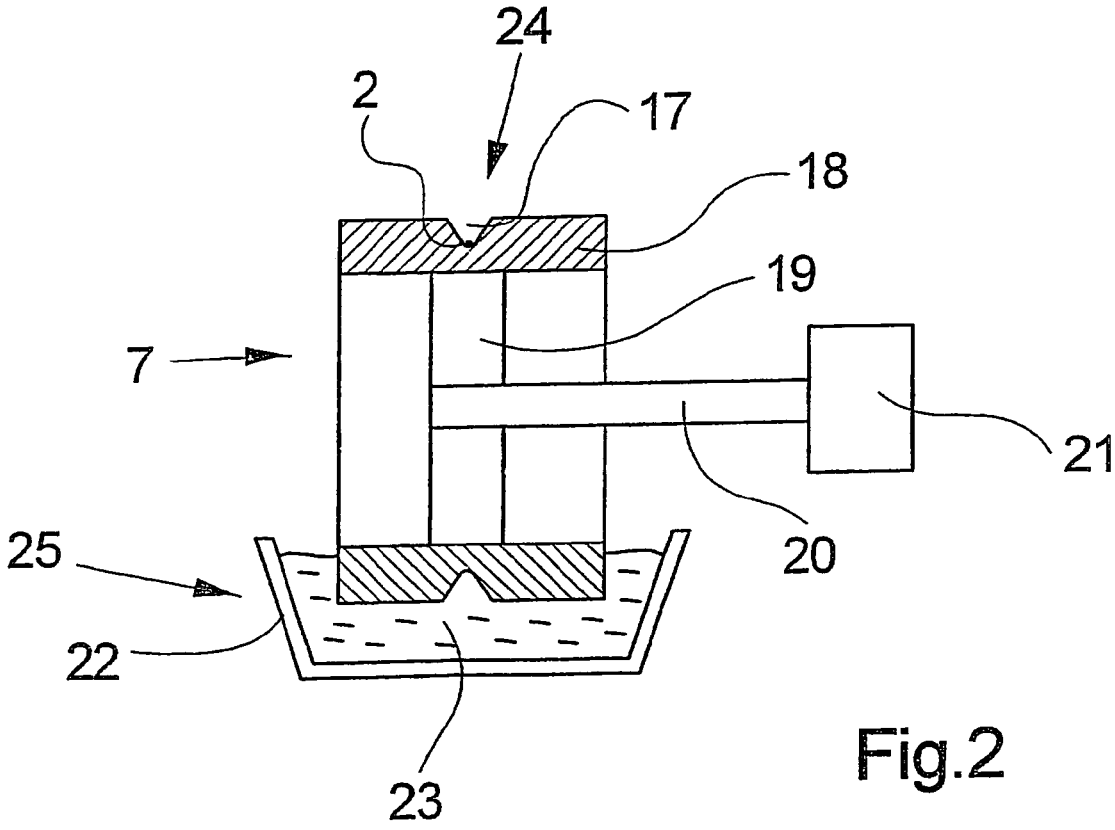
FIG. 2 is a schematic cross sectional view of a wetting device of the texturing machine according to the invention and as shown in FIG. 1.

In the embodiment of the texturing machine according to FIG. 1, the first feed system 4, the heating device 5, the wetting device 6, the cooling device 9, and the texturing unit 10 are arranged serially in one plane of the yarn path. With that, a straight yarn path is realized within the texturing zone, which requires no additional yarn guide elements. To be able to adjust the yarn friction to the required values while wetting the yarn, the cooling cylinder 7 is operated via a drive unit. FIG. 2 schematically illustrates a cross sectional view of an embodiment of the cooling cylinder 7. The cooling cylinder 7 comprises a casing 18, which connects via a hub 19 to the free end of a motor shaft 20. An electric motor 21 rotatably drives the motor shaft 20 such that the cooling cylinder 7 is driven for rotation (as shown in FIG. 1). On the circumference of the cooling cylinder 7, a yarn track 24 is provided in the form of a peripheral groove 17. The groove 17 has a V-shaped cross section, with the sides of the groove 17 forming an angle of preferably <90°. A metering device 25 is associated to the cooling cylinder 7. In the present embodiment, the metering device 25 is formed by a dip bath 22 that contains a cooling fluid 23. The cooling cylinder 7 and the dip bath are arranged relative to each other such that the cooling cylinder 7 partially immerses into the cooling fluid 23 contained in the dip bath 22. The immersion depth of the cooling cylinder 7 is dimensioned such that inside the dip bath 22 the cross section of the groove 17 on the circumference of the cooling cylinder 7 is completely filled with the cooling fluid 23. On the side of the cooling cylinder 7 opposite to the dip bath 22, the yarn 2 advances in the groove 17 on the circumference of the cooling cylinder 7.

The rotation of the cooling cylinder 7 causes a quantity of the cooling fluid 23 that is constantly contained in the groove 17 to be removed from the dip bath 22 and to be transported to a contact point between the advancing yarn 2 and the cooling cylinder 7. Thus, the cooling fluid 23 that the yarn 2 takes up from the groove 17 for its wetting is constantly renewed, with a yarn friction that develops between the groove 17 and the yarn 2 being dependent on the relative speed between the yarn 2 and the groove 17. In this connection, the electric motor 21 may drive the cooling cylinder 7 at such a circumferential speed that as little friction as possible acts upon the yarn 2. On the other hand, this also ensures that upon contact with the heated yarn, no mechanical damage occurs, such as filament breaks in the yarn.

Figure 3:
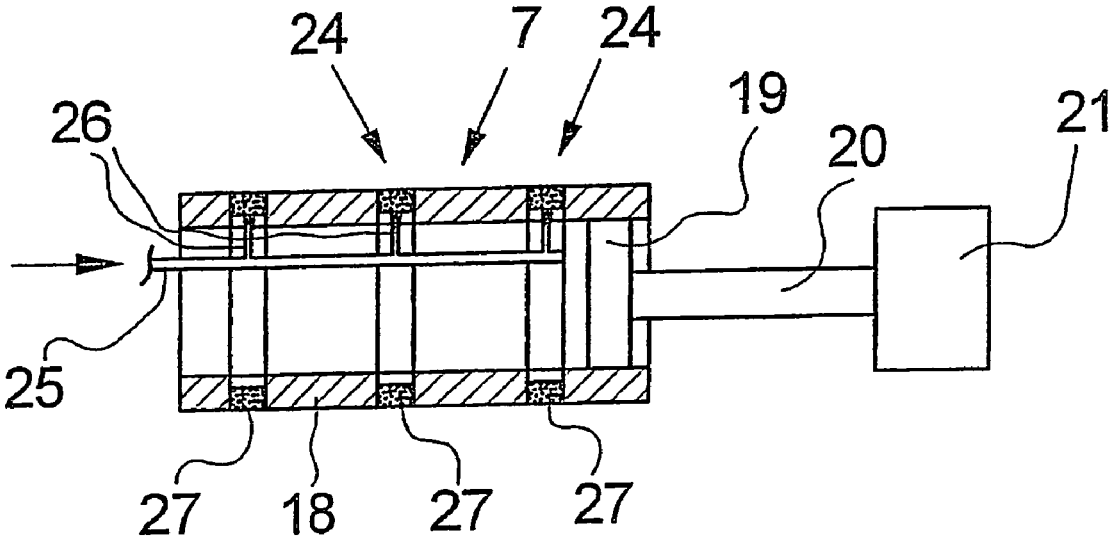
FIG. 3 is a schematic cross sectional view of a further embodiment of a wetting device according to the invention.

FIG. 3 schematically illustrates a further embodiment of a wetting device with a rotatable cooling cylinder 7. On its circumference, the cooling cylinder 7 comprises a plurality of parallel extending yarn tracks 24. The present embodiment shows three yarn tracks 24 that extend in side-by-side relationship. Each of the yarn tracks 24 is formed by a wetting ring 27 that is mounted on the circumference of the cooling cylinder 7. The wetting ring 27 consists of a porous material, which is fluid-permeable. The interior of the cooling cylinder 7 accommodates a metering device 25 that comprises a plurality of nozzles 26. The nozzles 26 are arranged in the interior of the wetting rings 27 which are held in the outer casing 18 of the cooling cylinder 7. For wetting the wetting rings 27, radial openings are provided in the outer casing 18, so that there is a direct contact between the cooling fluid emerging from the nozzles 26 and the wetting rings 27. A yarn advances in contacting relationship in each yarn track 24 on the circumference of the wetting rings 27, so that the cooling cylinder 7 is able to wet a plurality of yarns at the same time.

However, the embodiment of the wetting device as shown in FIG. 3 also offers the possibility of arranging the metering device outside of the cooling cylinder, so that the nozzles spray the cooling fluid onto the wetting rings from the outside.

Figure 4:
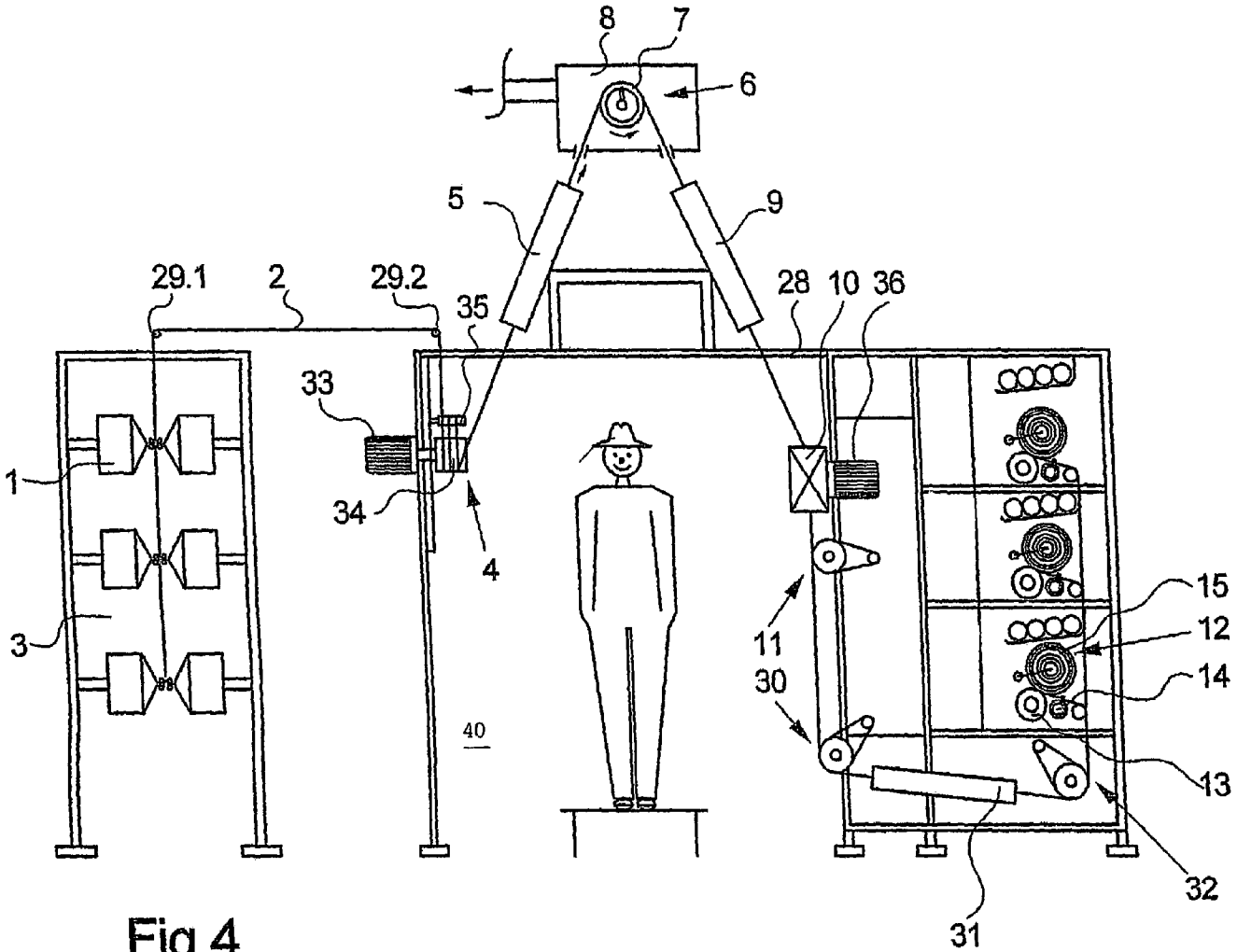
FIG. 4 is a schematic view of a further embodiment of a texturing machine according to the invention with a cooling cylinder of FIG. 3.

FIG. 4 schematically illustrates a further embodiment of the texturing machine according to the invention, which is provided with a wetting device shown in FIG. 3.

In FIG. 4, the drawing plane corresponds to the transverse plane, and in its longitudinal direction the texturing machine comprises a plurality of processing stations. In each processing station, one yarn is guided, textured, drawn, and wound. The takeup devices 12 occupy a width of three processing stations. Thus, three takeup devices 12 respectively overlie one another.

For accommodating the processing units, the texturing machine comprises a machine frame 28. The description of the processing units mounted to the machine frame 28 proceeds with reference to the path of a yarn 2 that is withdrawn from a feed yarn package 1. As shown in FIG. 4, a plurality of feed yarn packages 1 are arranged in a creel frame 3 and associated to the respective processing stations. In the processing station, a first feed system 4 withdraws the yarn 2 from the feed yarn package 1 via a first deflection roll 29.1 and a second deflection roll 29.2. In the direction of the advancing yarn, downstream of the first feed system 4, an elongate heating device 5 extends, through which the yarn 2 advances and in so doing, it is heated to a defined temperature. In the direction of the advancing yarn, downstream of the heating device 5, a cooling device 9 is provided. The heating device 5 and the cooling device 9 are arranged in an inverted V-shaped relationship to form a bent yarn path, and they are supported on the machine frame 28 above an operator aisle 40. The yarn 2 thus crosses above the operator aisle 40 along an inverted V-shaped path.

The wetting device 6 is arranged between the heating device 5 and the cooling device 9. It is constructed in accordance with the embodiment of FIG. 3, so that at this point the foregoing description is herewith incorporated by reference. The cooling cylinder 7 is arranged in the highest point between the heating device 5 and the cooling device 9, so that the yarn is additionally deflected as it loops the cooling cylinder 7. Contrary to the foregoing embodiment of the texturing machine according to FIG. 1, the drive unit 21 drives the cooling cylinder 7 to rotate in the opposite direction to the advancing yarn. The cooling cylinder 7 is arranged inside the collection chamber 8 that connects to a suction device, so that it is possible to directly remove vapor that collects while the yarns are being wetted.

Despite the bent yarn path within the texturing zone, also this embodiment essentially requires no additional yarn guide elements. Thus, it is possible to influence the yarn tension within the texturing zone advantageously by the drive unit 21 of the cooling cylinder 7. For example, the drive unit of the cooling cylinder 7 could connect to a control unit, which is coupled with a yarn tension sensor. With that, the drive unit 21 of the cooling cylinder 7 could be used to control not only the wetting of the yarn, but also at the same time a predetermined yarn tension within the texturing zone.

In the direction of the advancing yarn, downstream of the cooling device 9, the machine frame 28 mounts the texturing unit 10, a second feed system 11, and a third feed system 30. In this arrangement, the yarn 2 advances from the outlet of the cooling device 9 which is preferably a cooling tube, to the texturing unit 10. The texturing unit 10 which may be formed, for example, by a plurality of overlapping friction disks, is driven by a drive unit 36, preferably an electric motor.

The third feed system 30 delivers the yarn 2 directly into a set heater 31. To this end, the set heater 31 is supported on the underside of the machine frame 28. A fourth feed system 32 removes the yarn 2 from the set heater 31 and advances it to the takeup device 12. The third feed system 30 and the fourth feed system 32 are driven at different speeds so as to enable a shrinkage treatment of the yarn 2 inside the set heater 31.

In the present embodiment, an identical construction has been selected for the feed systems 4, 11, 30, and 32, which is therefore described in the following with reference to the embodiment of the first feed system 4. Each feed system comprises a godet 34 and a guide roll 35. The godet 34 is driven by a drive unit 33. The guide roll 35 is supported for free rotation, so that the yarn 2 advances with several loopings over the godet 34 and the guide roll 35.

In the present embodiment, the takeup device 12 is likewise schematically identified by a yarn traversing device 14, a drive roll 13, and a package 15. A package holder causes the package 15 to lie against the circumference of the drive roll 13.

In the foregoing embodiments, the cooling cylinder 7 is driven by an individual drive unit. Since texturing machines of the described type normally comprise a plurality of juxtaposed processing stations, it is also possible to drive a cooling cylinder with a plurality of yarn tracks by a common drive unit, or a plurality of cooling cylinders associated to the processing stations by group drive units. Likewise, the superstructures of the illustrated embodiments of the texturing machine according to the invention are exemplary. The number and design of the processing units upstream and downstream of the wetting device are arbitrary and can be replaced with similar assemblies. Essential in this connection is the intensive precooling by a contact wetting of the yarn in the manner of the invention.

The invention claimed is:

1. A yarn false twist texturing apparatus comprising means for advancing a yarn through a false twist texturing zone which comprises a heating device, a yarn wetting device, a cooling device, and a false twisting unit which are serially arranged along a yarn path of travel, said yarn wetting device being configured for precooling the advancing yarn and comprising a rotatable cooling cylinder which carries a cooling fluid on a circumferential yarn track, and with the cooling cylinder being positioned so that the advancing yarn is guided into contact with the yarn track, and wherein the cooling cylinder is positioned inside a collection chamber which connects to a suction device.

2. The texturing apparatus of claim 1, further comprising a drive unit for rotatably driving the cooling cylinder, with the cooling cylinder being drivable with a direction of rotation in the direction of the advancing yarn or with a direction of rotation opposite to the direction of the advancing yarn.

3. The texturing apparatus of claim 2, wherein the cooling cylinder drive unit is formed by an electric motor which is controllable at a variable rotational speed as a function of the speed of the advancing yarn.

4. The texturing machine of claim 1, wherein the yarn track is formed by a groove in the circumference of the cooling cylinder, with the groove containing the cooling fluid in the groove bottom.

5. The texturing apparatus of claim 1, wherein the cooling fluid is supplied to the yarn track on the circumference of the cooling cylinder by a metering device.

6. The texturing apparatus of claim 5, wherein the metering device is formed by a dip bath which contains a supply of cooling fluid and into which the circumference of the cooling cylinder immerses in part.

7. The texturing apparatus of claim 5, wherein the metering device is formed by at least one nozzle which is arranged in an interior of the cooling cylinder or outside of the cooling cylinder, for supplying the cooling fluid to the yarn track.

8. The texturing apparatus of claim 5 wherein the yarn track comprises a wetting ring formed of a porous material and positioned to encircle the circumference of the cooling cylinder.

9. The texturing apparatus of claim 8 wherein the metering device comprises at least one nozzle positioned in a hollow interior of the cooling cylinder for injecting the cooling fluid through a radial opening in the cooling cylinder and into contact with the wetting ring.

10. The texturing apparatus of claim 1, wherein the heating device, the cooling cylinder, and the cooling device are arranged to form a substantially straight yarn path.

11. The texturing apparatus of claim 1, wherein the heating device, the cooling cylinder, and the cooling device are arranged to form a bent yarn path, with the yarn being deflected by the cooling cylinder between the heating device and the cooling device.

12. The texturing machine of claim 1, wherein the advancing means comprises a first feed system positioned upstream of the heating device and wherein the first feed system and the heating device are arranged to form a straight yarn path, and/or that the cooling device and the texturing unit are arranged to form a straight yarn path.

13. The texturing apparatus of claim 1, wherein the cooling cylinder comprises on its circumference a plurality of parallel extending yarn tracks, with one yarn being associated with each yarn track.

14. The texturing apparatus of claim 1, wherein the advancing means comprises a first feed system positioned upstream of the heating device and a second feed system positioned downstream of the false twisting unit, and further comprising drive means for controlling the operating speeds of the first and second feed systems so as to permit the yarn to be drawn as it advances therebetween.

15. The texturing apparatus of claim 14, further comprising a takeup device positioned downstream of the second feed system for winding the textured yarn into a package.

16. A yarn false twist texturing apparatus comprising means for advancing a yarn through a false twist texturing zone which comprises a heating device, a yarn wetting device, a cooling device, and a false twisting unit which are serially arranged along a yarn path of travel, said yarn wetting device being configured for precooling the advancing yarn and comprising a rotatable cooling cylinder which carries a cooling fluid on a circumferential yarn track, and with the cooling cylinder being positioned so that the advancing yarn is guided into contact with the yarn track, wherein the yarn track is formed by a groove in the circumference of the cooling cylinder, with the groove containing the cooling fluid in the groove bottom.

17. A yarn false twist texturing apparatus comprising means for advancing a yarn through a false twist texturing zone which comprises a heating device, a yarn wetting device, a cooling device, and a false twisting unit which are serially arranged along a yarn path of travel, said yarn wetting device being configured for precooling the advancing yarn and comprising a rotatable cooling cylinder which carries a cooling fluid on a circumferential yarn track, and with the cooling cylinder being positioned so that the advancing yarn is guided into contact with the yarn track, wherein the cooling fluid is supplied to the yarn track on the circumference of the cooling cylinder by a metering device, and wherein the metering device is formed by a dip bath which contains a supply of cooling fluid and into which the circumference of the cooling cylinder immerses in part.

* * * * *